United States Patent [19]

Henning

[11] Patent Number: 4,690,292

[45] Date of Patent: Sep. 1, 1987

[54] SAFETY CLOSURE

[75] Inventor: John C. Henning, Fairfield, Ohio

[73] Assignee: Product Investment Incorporated, Cincinnati, Ohio

[21] Appl. No.: 876,930

[22] Filed: Jun. 20, 1986

[51] Int. Cl.[4] ..... B65D 55/00

[52] U.S. Cl. ..... 215/201; 215/206; 215/219; 220/210

[58] Field of Search ..... 215/201, 206, 207, 208, 215/214, 217, 218, 219; 220/210, 255

[56] References Cited

U.S. PATENT DOCUMENTS

| | | | |
|---|---|---|---|
| 2,009,216 | 7/1935 | Anibal | 215/98 |
| 2,226,390 | 12/1940 | Rosevear, Jr. | 215/98 |
| 2,381,207 | 8/1945 | Coleman | 215/98 |
| 2,831,595 | 4/1958 | Aspenes | 215/9 |
| 3,059,801 | 10/1962 | Dragon | 215/98 |
| 3,120,318 | 2/1964 | Rigor | 215/9 |
| 3,160,301 | 12/1964 | Milbourne | 215/219 |
| 3,311,247 | 3/1967 | Rigor | 215/206 |
| 3,710,970 | 1/1973 | Elfline | 215/219 X |
| 3,797,704 | 3/1974 | Dykes | 222/41 |
| 3,830,394 | 8/1974 | Lestaevel | 215/9 |
| 3,843,007 | 10/1974 | Meyer | 215/206 |
| 3,850,324 | 11/1974 | Meyer | 215/206 |
| 4,083,209 | 4/1978 | Sloan, Jr. | 220/210 X |
| 4,353,473 | 10/1982 | Morris | 215/220 |
| 4,527,406 | 7/1985 | Baker | 220/210 X |
| 4,605,135 | 8/1986 | Ryder | 215/217 X |

*Primary Examiner*—Steven M. Pollard

*Attorney, Agent, or Firm*—Wood, Herron & Evans

[57] ABSTRACT

A safety closure is disclosed for containers of potentially harmful substances. The safety closure includes an inner cap threaded over the container and an outer cap which encloses and is rotatably supported by the outer cap which tracks in a groove in the inner cap. The groove includes an inner section in which the lug is free to move, an outer section including two abutments, and sections interconnecting the inner and outer section. When the driving lug engages either of the abutments, the outer cap can rotate the inner cap.

17 Claims, 19 Drawing Figures

SAFETY CLOSURE

BACKGROUND OF THE PRESENT INVENTION

The present invention relates to closures for containers and is particularly directed to a safety closure for containers adapted to store substances such as drugs or chemicals which may be potentially harmful to children or even some adults. In the past, there have been various proposals to provide safety caps for medicine bottles and similar containers. One common closure of this type includes a rotatable cap having an outwardly extending lug which must be aligned with an indicia on the container or on a band surrounding the container neck. After it has been properly aligned, the lug is pushed upwardly to open the bottle. While closures of this type have provided relatively good protection against unauthorized access to the container contents by children, the containers have the substantial disadvantage that they are difficult to operate particularly by aged or infirm users, people with arthritis or the like.

Other types of closures have been proposed which operate on the combination lock principle. Examples of this type of closure are shown in Lesteavel U.S. Pat. No. 3,830,394, Meyer U.S. Pat. No. 3,850,324, Dragon U.S. Pat. No. 3,059,801, and Rosevear U.S. Pat. No. 2,226,390. These closures while requiring less force to operate suffer from the disadvantage that they are complex, relatively expensive, and difficult for some people to manipulate.

SUMMARY OF THE PRESENT INVENTION

The present invention is directed to a safety cap which provides a high degree of protection against opening by children. It is an object of the present invention to provide a safety closure which requires only a minimal force to operate so that the container may be comfortably opened by infirmed adults or people afflicted with arthritis and the like.

It is a further object of the present invention to provide a safety closure consisting of only a small number of molded parts which are readily assembled with the result that the closure is of relatively low cost.

More particularly, the present invention is predicated upon the concept of providing a safety cap including an inner cap which is threaded on the container and an outer cap which surrounds and is rotatably mounted on the inner cap. The outer cap carries a driving lug which can be shifted in and out toward and away from the circumference of the outer cap. This driving lug tracks in a groove formed in the upper surface of the inner cap. The groove is configured to form an inner circular section. When the driving lug is in engagement with this section, the outer cap turns freely relative to the inner cap and it is impossible to open the closure. The groove is further configured so that when the driving lug has been shifted through various sections of the groove it is brought into contact with an abutment. Thereafter, further rotation of the outer cap causes the inner cap to be rotated and disengaged from the container.

More particularly, in a preferred embodiment, the driving lug is mounted on a pivot member which also carries an operating lug extending upwardly through a slot in the outer cap. The closure is opened by first rotating the outer cap to bring the driving lug into registry with a section of the groove interconnecting the inner circular section and an intermediate arcuate section. When the driving lug is so positioned, it is shifted outwardly by pushing on the operating lug. The outer cap is again rotated while the driving lug is brought in alignment with another radial section of the groove. The driving lug is then shifted outwardly into an outer section of the groove. Finally, the outer cap is rotated to bring the driving lug into engagement with an abutment establishing a driving connection between the outer and inner caps. Thereafter, continued rotation of the outer cap causes the inner cap to rotate to its unlocked position. The closure is replaced simply by engaging the internal threads on the inner cap with the male threads on the container and rotating the outer cap in a clockwise direction in the usual manner. After the inner cap is seated in its closed position, the outer cap is rotated in the opposite position briefly to bring the driving lug back into the inner circular track. Thereafter in order to reopen the closure, the user must repeat the sequence of steps described above.

One advantage of the present invention is that the closure requires no more force to open the closure than is required to open a conventional threaded cap. Thus, an adult who follows the proper sequence of steps can readily open the closure even though the adult is suffering from some affliction which limits the amount of force he can assert on the cap.

Another advantage of the present invention is that it provides an extremely secure container. There is no more than a miniscule possibility that a child would stumble onto the right sequence of operations necessary to open the closure.

A still further advantage of the present invention is that the closure requires only three molded parts so that the closure may be economically manufactured.

These and other objects and advantages of the present invention will be more readily apparent from a consideration of the following description of the drawings illustrating a preferred and alternative embodiment of the present invention.

From the foregoing disclosure of the general principles of the present invention and the above description of a preferred and alternate embodiment, those skilled in the art will readily comprehend various modifications to which the invention is susceptible.

DESCRIPTION OF THE PREFERRED EMBODIMENT

One preferred form of safety closure 10 constructed in accordance with the principles of the present invention is illustrated in FIGS. 1–12. As there shown, the closure is applied to a container 11 adapted to store materials such as pills, liquid medicines or the like which are hazardous particularly if ingested by children. It is to be understood that the details of construction of container 11 constitute no part of the present invention. This container may be formed of glass or plastic and can be of any desired configuration so long as it is provided with an upper end having suitable threads 12.

Figure 2:
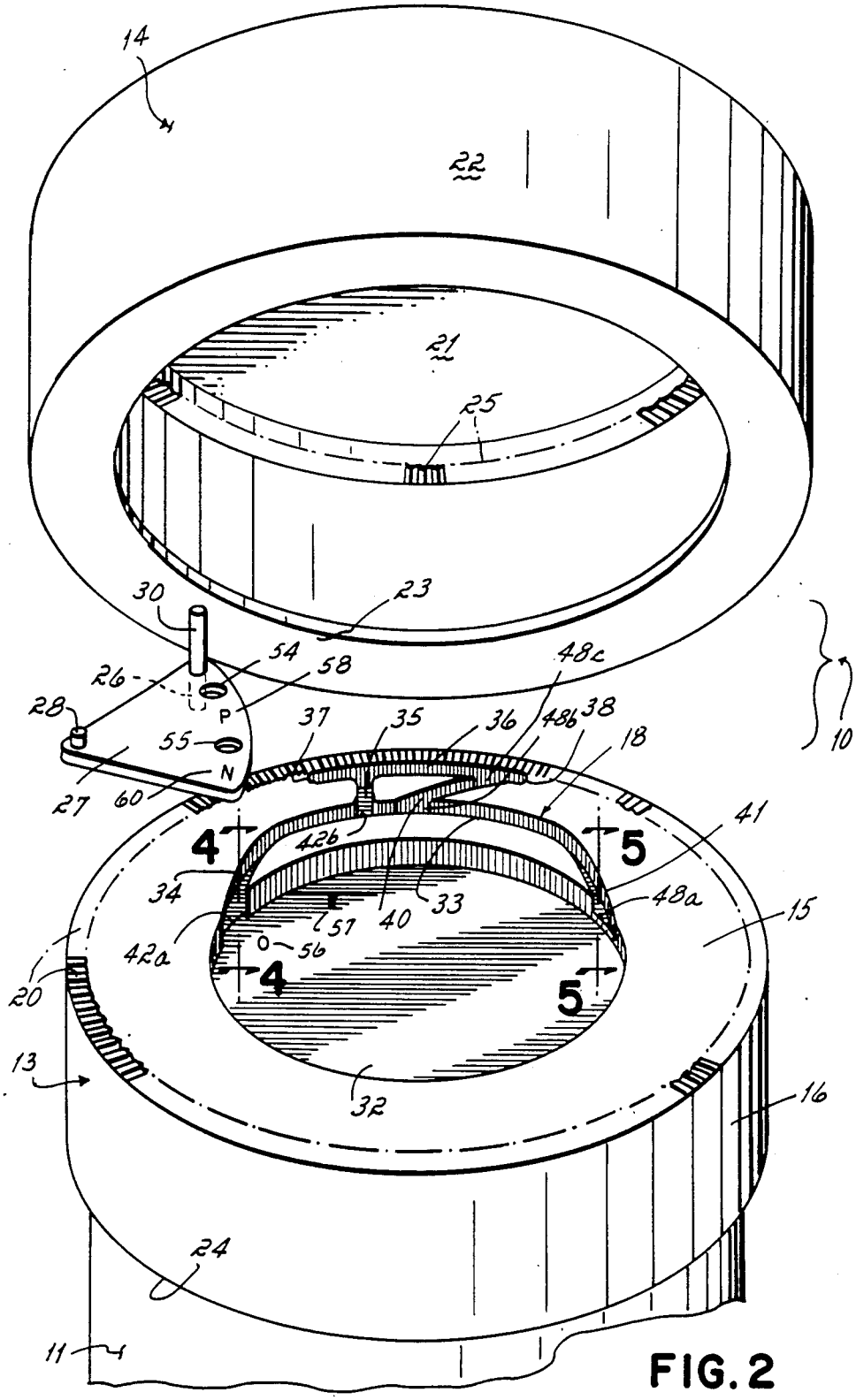
FIG. 2 is an enlarged expanded view of this closure.

Safety closure 10 comprises an inner cap 13 and an outer cap 14. Inner cap 13 includes a top wall 15 of generally circular construction and a depending peripheral wall 16. Peripheral wall 16 is provided with internal threads 17 adapted to threadably engage male threads 12 formed on the container 11. The top wall 15 of the inner cap is provided with a groove 18 which is best illustrated in FIG. 2 and is described in detail below. the top wall 15 of the inner cap also is provided with a plurality of radial serrations, or teeth, 20 which extend about the periphery of the top wall.

The second major component of the closure is an outer cap 14. This cap substantially encloses the inner cap and is rotatably supported thereon. Consequently, the inner cap can be turned to open container 11 only by establishing a driving connection between the outer cap 14 and inner cap 13.

More particularly, outer cap 14 includes a top wall 21 and a depending peripheral side wall 22 which terminates in an inwardly extending bottom flange 23. Bottom flange 23 extends inwardly along the lowermost edge 24 of peripheral wall 16 of the inner cap while side wall 22 of the outer cap surrounds peripheral wall 16 of the inner cap. In the preferred embodiment the outer cap carries a plurality of serrations or teeth 25 formed about the periphery of the under surface of top wall 21. These serrations mate with the serrations 20 formed on the inner cap. By means of the construction thus described, outer cap 14 is supported for free rotation around inner cap 13.

Figure 3:
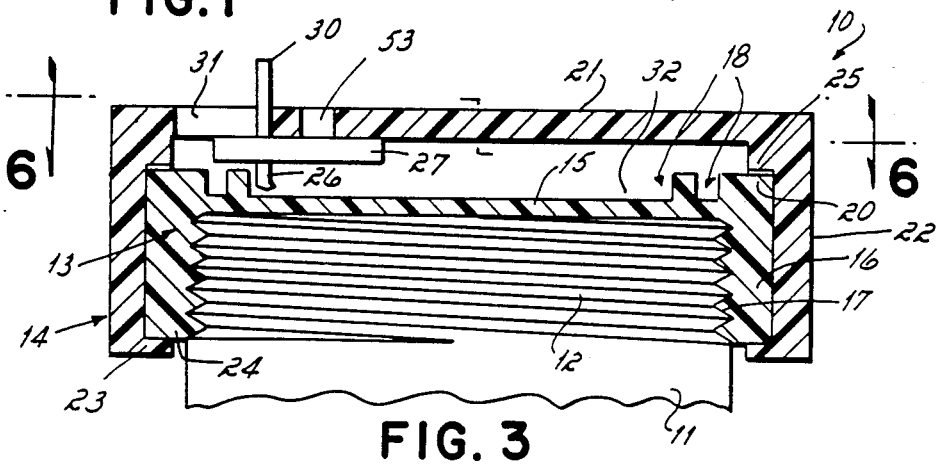
FIG. 3 is a cross-sectional view along line 3—3 of FIG. 1.

The closure 10 additionally includes a driving lug 26 as shown in FIG. 3. This lug is mounted on a pivot member 27 which is rotatably supported by the top wall 21 of the outer cap by means of a pivot pin 28 rotatably journaled in a suitable opening in top wall 21. The pivot member is loosely sandwiched between top wall 15 of the inner cap and top wall 21 of the outer cap. Pivot member 28 also carries an operating lug 30 which extends upwardly through an arcuate slot 31 formed in top wall 21. Operating lug 30 is adapted to be grasped by the user and shifted along slot 31 to move the operating lug 26 in a generally radial direction toward and away from the circumference of the outer cap.

As shown in FIG. 3, operating lug 26 extends downwardly and is received within groove 18 of the inner cap member. The configuration of groove 18 is shown in FIG. 2. As there shown, the groove includes an inner circular section 32. It is to be understood that when driving lug 26 is disposed within section 32, the outer cap can rotate freely with respect to the inner cap. The slot 18 further comprises an intermediate arcuate section 33 which is generally centric with the outer wall of the circular section 32 and is spaced outwardly therefrom. Groove 18 also is provided with a first radial section 34 which interconnects the inner circular section 32 and intermediate arcuate section 33. It is to be understood that first radial section 34 and a second radial section 35 which extends between the intermediate arcuate section 33 and an outer arcuate section 36 are not necessarily disposed on a true radius of the outer cap. However, these sections do include a radial component in that they extend outwardly toward the circumference of the outer cap.

Again as shown in FIG. 2, outer arcuate section 36 includes two closed ends or abutments 37 or 38 disposed at opposite ends of section 36. In addition to the sections of groove 18 above described, the groove includes a return section 41 which extends from outer arcuate section 36 to intermediate arcuate section 33. Additionally, a third radial section 41 interconnects the end of intermediate arcuate section 33 remote from radial section 34 with the inner circular section 32.

Figure 4:
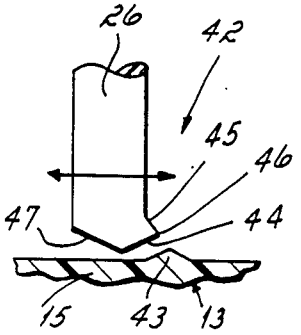
FIG. 4 is an enlarged view taken along line 4—4 of FIG. 2 of a "resistance" gate.

In the preferred embodiment, groove 18 incorporates both "resistance" gates and "one-way" gates. A resistance gate 42 is illustrated in FIG. 4. This gate is intended to provide resistance to the movement of the driving lug 26 past the gate in either direction. However, upon application of a relatively small force, the driving lug can be moved past the gate. More particularly as shown in FIG. 4, resistance gate 42 comprises a generally triangular projection 43 extending upwardly from the floor of the groove. This projection is adapted to be engaged by a sloping bottom face 44 of driving lug 26. Sloping bottom face 44 meets with a second sloping face 45 to form a radial projection 46 on the driving lug. The driving lug also includes a second, oppositely sloping lower face 47. The driving lug 26 can be moved through resistance gate 42 in a left to right direction in FIG. 4 by the camming engagement of sloping face 44 with projection 43. This engagement causes lug 26 to be lifted upwardly slightly to permit movement of the lug over the triangular projection. Similarly, right to left movement is accommodated by the engagement of the surface 47 with the surface of projection 43. As is apparent from FIG. 4, face 47 is substantially longer than face 46 and the angle that face 47 makes with the horizontal is substantially less than the angle made by face 46. Consequently, driving lug 26 encounters appreciably more resistance in moving from left to right in FIG. 4 than it does in moving from right to left.

Two resistance gates 42*a* and 42*b* are provided in slot 18. These gates prevent the operating lug from being inadvertently shifted (as for example by a child shaking the container) into engagement with abutment 37 in which position the closure could be opened. More particularly, resistance gate 42*a* is disposed at the juncture of inner section 32 and radial section 34 while a second resistance gate 42*b* is disposed at the juncture of arcuate intermediate section 33 and second radial section 35.

Figure 5:
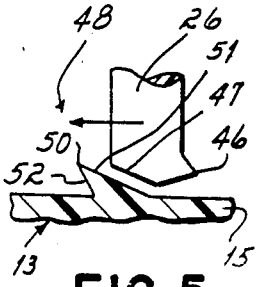
FIG. 5 is an enlarged view taken along line 5—5 of FIG. 2 of a "one-way" gate.

Slot 18 also incorporates three one-way gates 48 which gates are designed to permit passage of driving lug 26 through the gate in only one direction while preventing movement of the driving lug in the opposite direction. One suitable form of one-way gate 48 is shown in FIG. 5. As there shown, the gate incorporates an upstanding triangular projection 50 which extends upwardly from the bottom wall of groove 18. Projection 50 has a sloping face 51 and an undercut face 52. As shown in FIG. 5, movement of the driving lug 26 in a direction from right to left is permitted by the cooperative engagement of sloping face 51 of the gate and sloping wall 47 of the driving lug. However, reverse movement, i.e. movement of lug 26 from left to right, is prevented by the entrapment of radial projection 46 against undercut surface 52. As shown in FIG. 5, wall 47 makes a relatively small angle with the horizontal so that minimal resistance is encountered when lug 26 is shifted from right to left as viewed in FIG. 5.

Three such one-way gates are provided in groove 18. Specifically, one-way gate 48*a* is provided at the juncture of the inner circular section 32 and radial section 41. This gate prevents outward movement of lug 26 from inner section 32 to radial section 41. A second one-way gate 48*b* is provided at the juncture of intermediate section 33 with return section 40. Gate 52*b* prevents movement of the driving lug into return section 40 from intermediate section 33. A third one-way gate 48*c* prevents movement of driving lug 26 from a position adjacent to closed end 38 back through outer slot 36 toward closed end 37.

It is to be understood that the teeth of cooperating serrations 20 and 25 are located so that the upper and lower caps are lightly held in position with the driving lug 26 precisely in alignment with gates 42*a* and 42*b*. This alignment facilitates the lug through the gates when opening the closure as explained below. The parts of the present closure are preferably formed of a molded plastic such as polyethylene. In order to assemble the closure, pivot member 27 is placed against the outer cap and pivot pin 28 is inserted through a suitable opening in the cap. The outer cap 14 is then snapped over the inner cap 13 to bring the two in to assembled relationship as shown in FIG. 3 with pivot member 27 being loosely sandwiched between the two caps.

Figure 1:
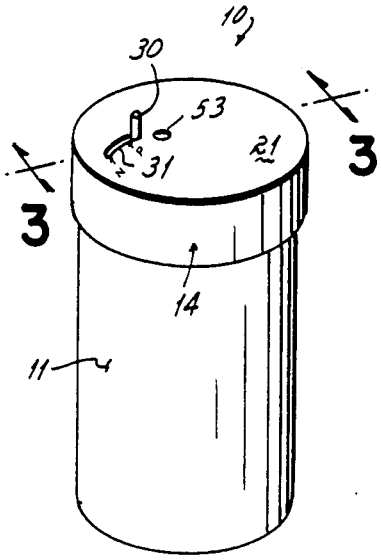
FIG. 1 is a perspective view of a container fitted with a closure of the present invention.

Assuming that the inner cap is threaded over the end of a container 11 illustrated in FIGS. 1 and 3, the user must manipulate the operating lug 30 and top cap to bring driving lug 26 into engagement with closed end 37 of groove 18. In order to facilitate the necessary manipulations, certain cooperating indicia are provided on the container members. The proper successive manipulations of the outer cap and operating lug cause these indicia to be displayed in a recognizable sequence such as "O-P-E-N". More particularly, the top wall of the outer cap is provided with a transparent window 53. The pivot member 27 is similarly provided with two transparent windows or openings 54 and 55. The inner cap member is also provided with two suitable indicia such as the letters "O" and "E" indicated respectively by reference numerals 56 and 57. The pivot member 27 is similarly provided with two indicia such as the letters "P" and "N" indicated by numerals 58 and 60 in FIG. 2. In addition, two other indicia such as a "P" and "N" indicated by reference numerals 61 and 62 in FIG. 1 are provided adjacent slot 31.

Figure 6:
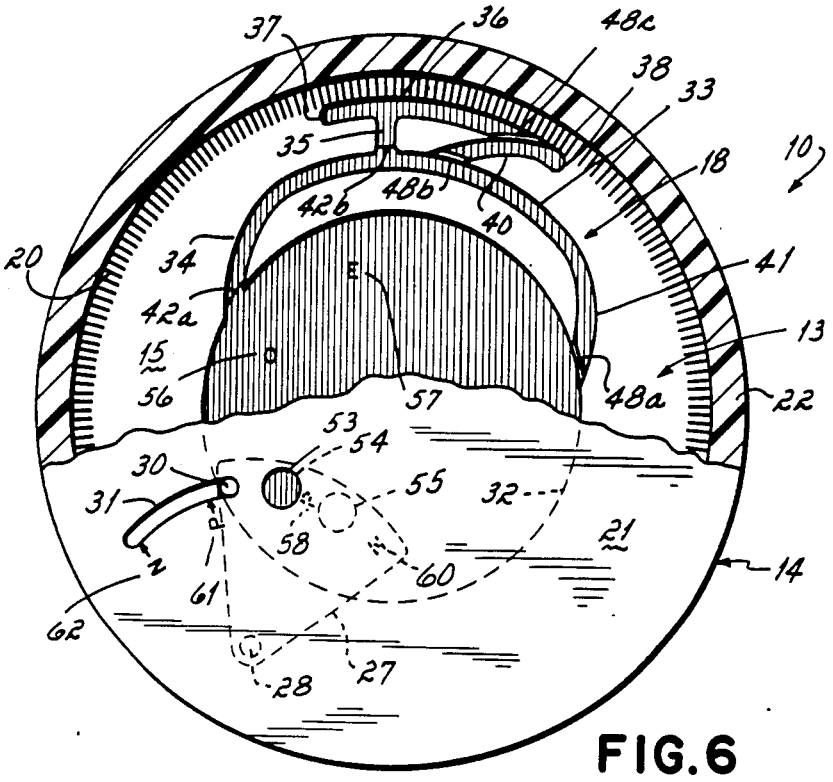
FIG. 6 is a cross-sectional view taken along line 6—6 of FIG. 3 showing the outer cap member in its freely rotating or "closed" position.
Figure 7:
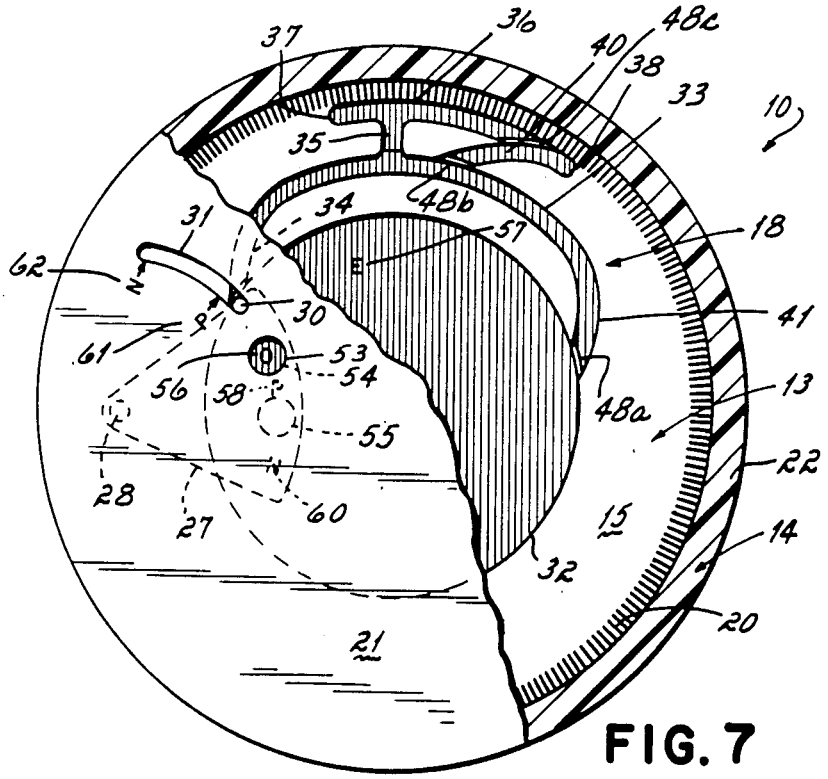
FIG. 7 is a view similar to FIG. 6 showing the closure members in the first position of the opening sequence, i.e. in alignment with the first resistance gate.
Figure 8:
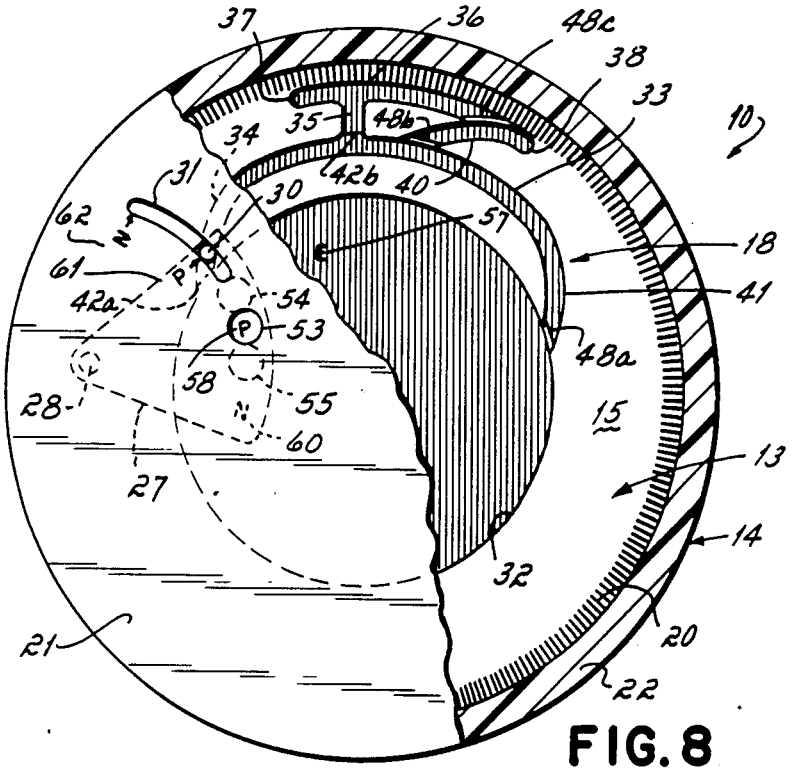
FIG. 8 is a view similar to FIG. 6 showing the closure members in the second position of the opening sequence.

In operation assuming that the closure inner cap is threaded over the container and that driving lug 26 is located within circular section 32, the outer cap can be freely rotated in either direction (see FIG. 6). To open the closure, the outer cap 14 is rotated until the first indicia, the "O" 56, is visible through the aligned windows 53 and 54. The parts are then positioned as shown in FIG. 7 with the driving lug at the entrance to gate 42*a*. Operating lug 30 is pushed outwardly moving driving lug 26 through gate 42*a* until the operating lug is in registry with the letter "P" indicia 61. At this point, the driving lug 26 has cleared gate 42*a* and the letter "P" is visible in window 53. Lug 26 is in a position to permit rotative movement of outer cap 14. This position is illustrated in FIG. 8.

Figure 9:
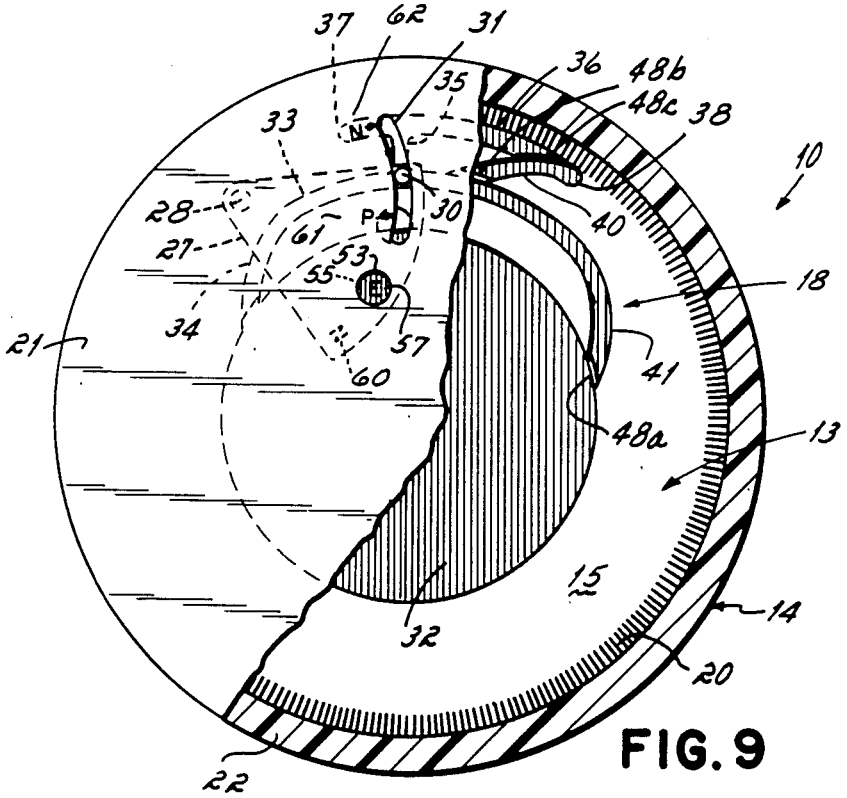
FIG. 9 is a view similar to FIG. 6 showing the closure members in the third position of the opening sequence.
Figure 10:
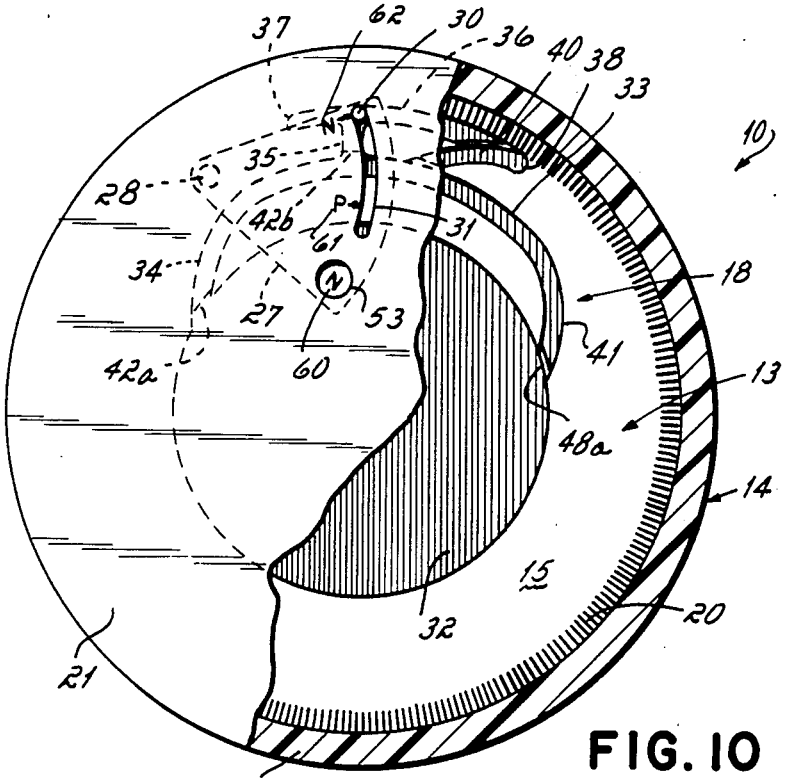
FIG. 10 is a view similar to FIG. 6 showing the closure members in their fourth position of the operating sequence.
Figure 11:
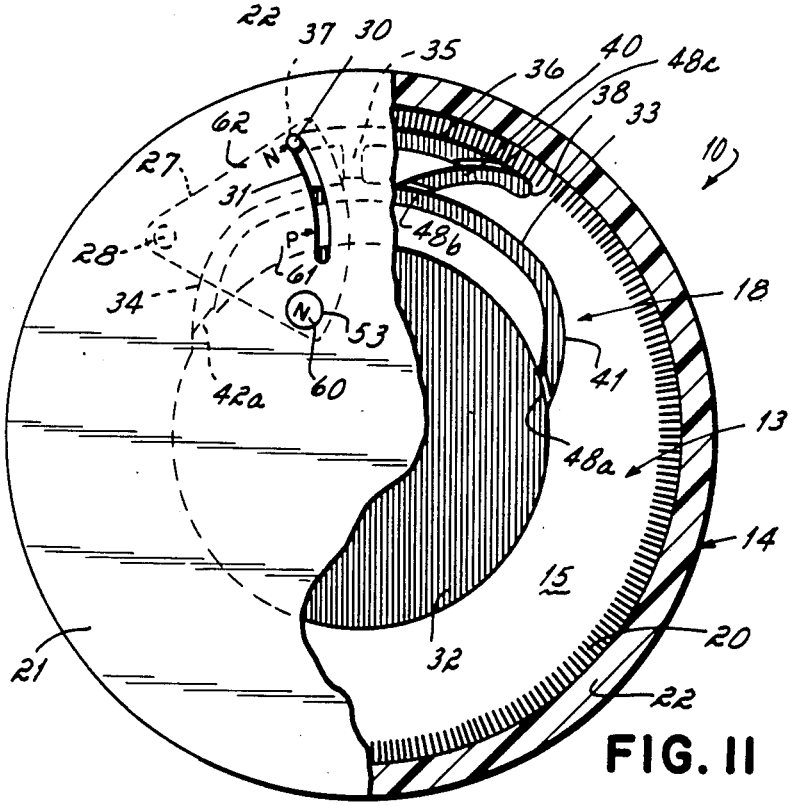
FIG. 11 is a view similar to FIG. 6 showing the driving lug positioned to rotate the inner cap to an open position.
Figure 12:
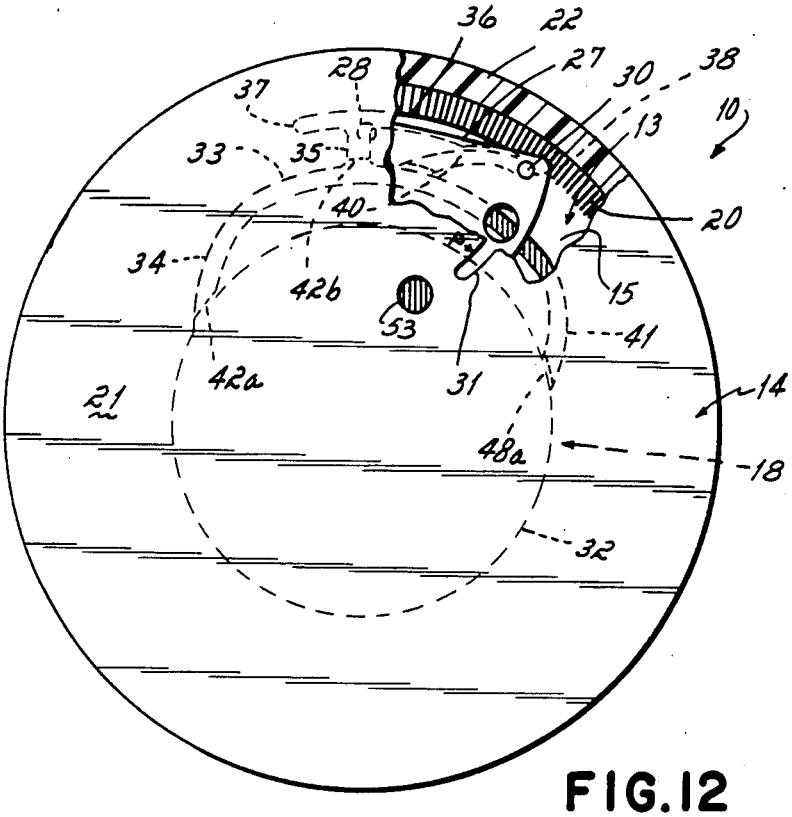
FIG. 12 is a view similar to FIG. 6 showing the driving lug positioned to rotate the inner cap to a closed position.
Figure 13:
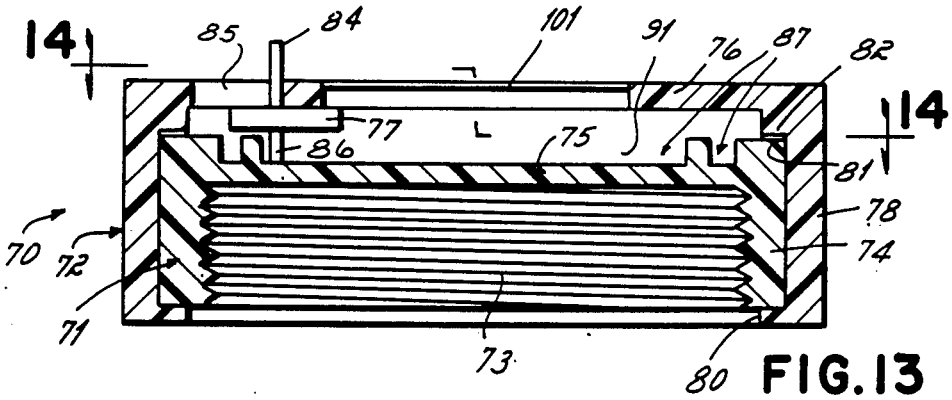
FIG. 13 is a cross-sectional view similar to FIG. 3 through a modified form of closure.

In the next step, the outer cap 14 is rotated in an counterclockwise direction until the letter "E" is visible through window 53 in the outer cap and window 55 in the pivot member 27. At this point, as illustrated in FIG. 9, driving lug 26 is disposed at the entrance of gate 42*b*. With the parts in this position, the operating lug 30 is shifted outwardly until it is aligned with the "N" indicia 62 on the cap, and the letter "n" on pivot member 27 is visible through window 53. At this point the driving lug 26 is disposed in outer arcuate section 36 at the juncture of radial section 35 and outer arcuate section 36 of groove 18 (see FIG. 10). In the final step of opening the closure, the outer cap 14 is rotated in a counterclockwise direction to bring driving lug 26 into engagement with abutment 37 as illustrated in FIG. 11. This establishes a driving connection between the outer cap and inner cap so that further counterclockwise motion of the outer cap rotates the inner cap to disengage it from threads 12 in a conventional manner.

After contents of the container 11 have been removed, the closure may be replaced by threading the inner cap 13 over the male threads 12. This is accomplished by rotating the outer cap clockwise causing the driving lug 26 to move along outer arcuate section 36 into engagement with abutment 38 (see FIG. 12). Further counterclockwise movement of the outer cap is thus transmitted through the driving lug to the inner cap which is threaded onto container 11 in a conventional manner. In order to reset the cap to a "safety" position, the outer cap is rotated slightly in a counterclockwise direction. Driving lug 26 is blocked from movement along section 36 by one-way gate 48*c*. The lug is thus guided along return section 40 into intermediate arcuate section 33. After the driving lug has entered this section, further rotative movement of the outer cap in either direction will cause the driving lug to return to the inner circular section 32 either through radial section 34 or radial section 41 of the groove. Once the driving lug has returned to this inner circular section, the outer cap may be freely rotated in either direction.

A modified form of closure 70 is illustrated in FIGS. 13–17. As there shown, the modified closure includes an inner cap 71 and an outer cap 72. The inner cap 71 is provided with internal thread 73 adapted to be threaded over the male threads of a container in the same manner as the preferred embodiment. The inner cap also includes a peripheral wall 74 and a top wall 75. The outer cap 72 substantially encloses the inner cap and is rotatable about it. Outer cap 72 includes a top wall 76 which overlies top wall 75 of the inner cap and supports a pivot member 77. The outer cap member further includes a side wall 78 which surrounds peripheral wall 74 of the inner cap and a lower inwardly turned flange 80 which abuts the bottom surface of this peripheral wall. As in the preferred embodiment, serrations 81 are formed about the periphery of the inner cap while cooperating serrations 82 are formed about the periphery of the outer cap.

Pivot member 77 is rotatably mounted to the top wall 76 by means of a pivot pin 83 similar to pivot pin 28 of the preferred embodiment. As in the preferred embodiment, pivot pin 83 is rotatably received within an opening formed in the top wall with the pivot member 77 being loosely sandwiched between walls 75 and 76.

Pivot member 77 carries an operating lug 84 which extends upwardly through an arcuate slot 85 in top wall 76 and a driving lug 86 which extends downwardly into a groove 87 formed in top wall 75 of the inner cap. As in the preferred embodiment, groove 87 includes a first abutment 88 and a second abutment 90 disposed so that the outer cap 72 is effective to rotate the inner cap 71 in a counterclockwise direction to open the closure when driving lug 86 engages abutment 88 and is effective to rotate the inner cap in the opposite direction to close the lid when the driving lug engages abutment 90.

Figure 14:
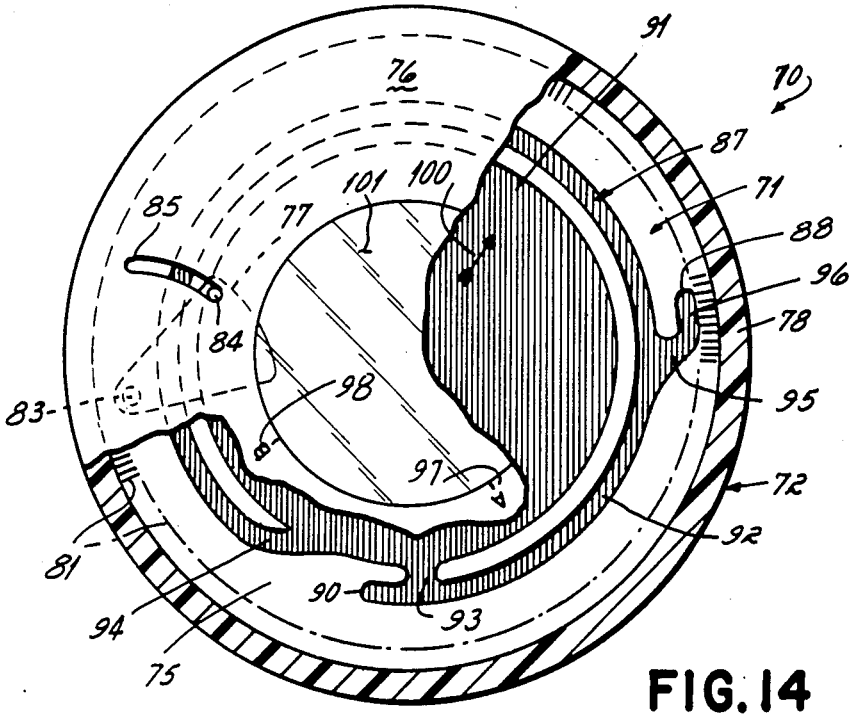
FIG. 14 is a view taken along line 14—14 of FIG. 13 showing the outer cap in its freely rotating or closed position.
Figure 15:
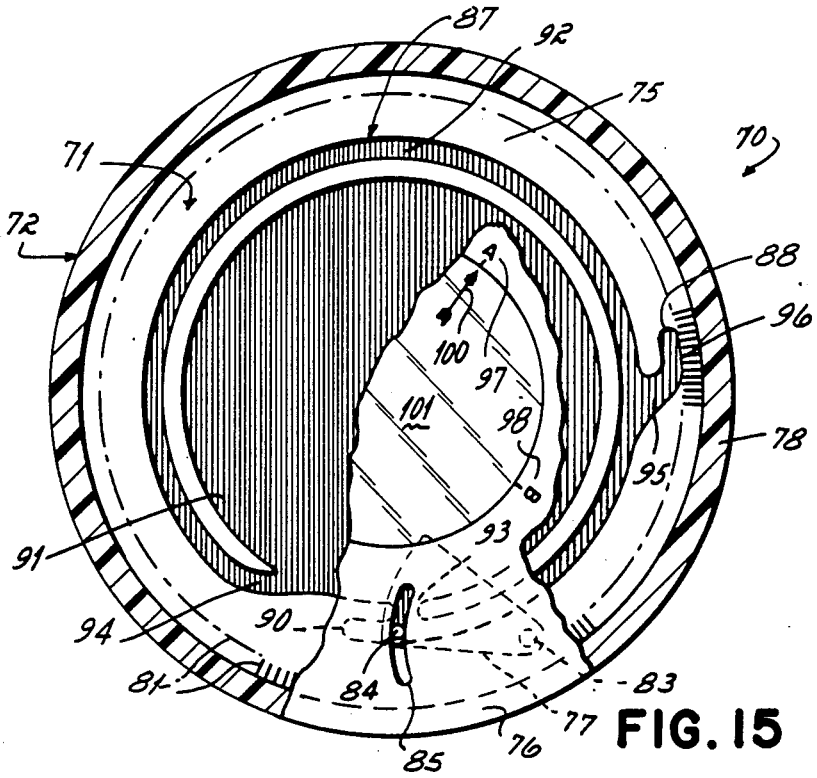
FIG. 15 is a view similar to FIG. 14 showing the closure members in the first position of the opening sequence.
Figure 16:
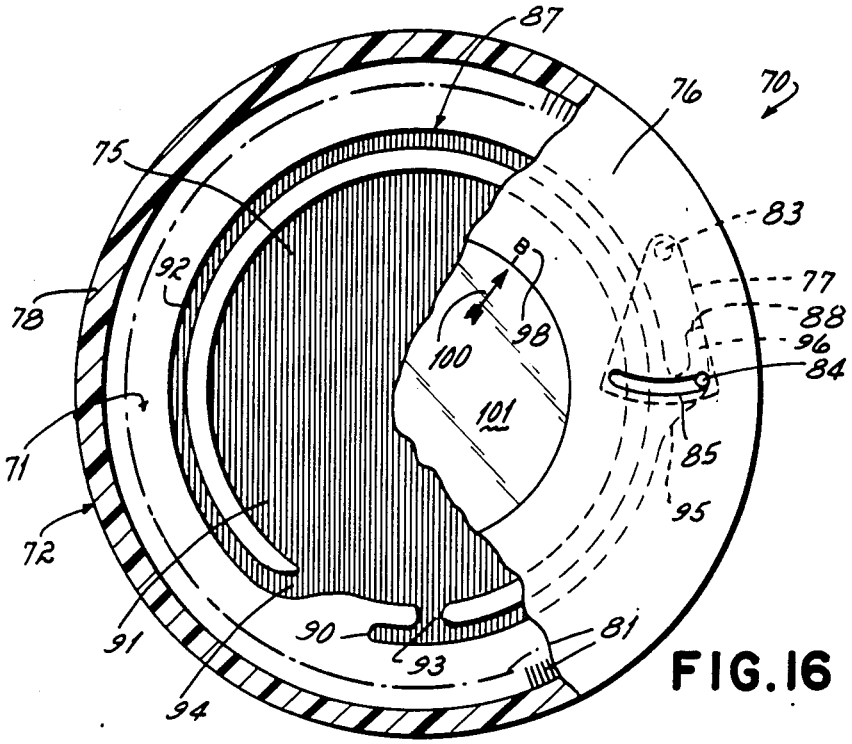
FIG. 16 is a view similar to FIG. 14 showing the closure members in the second position of the opening sequence.
Figure 17:
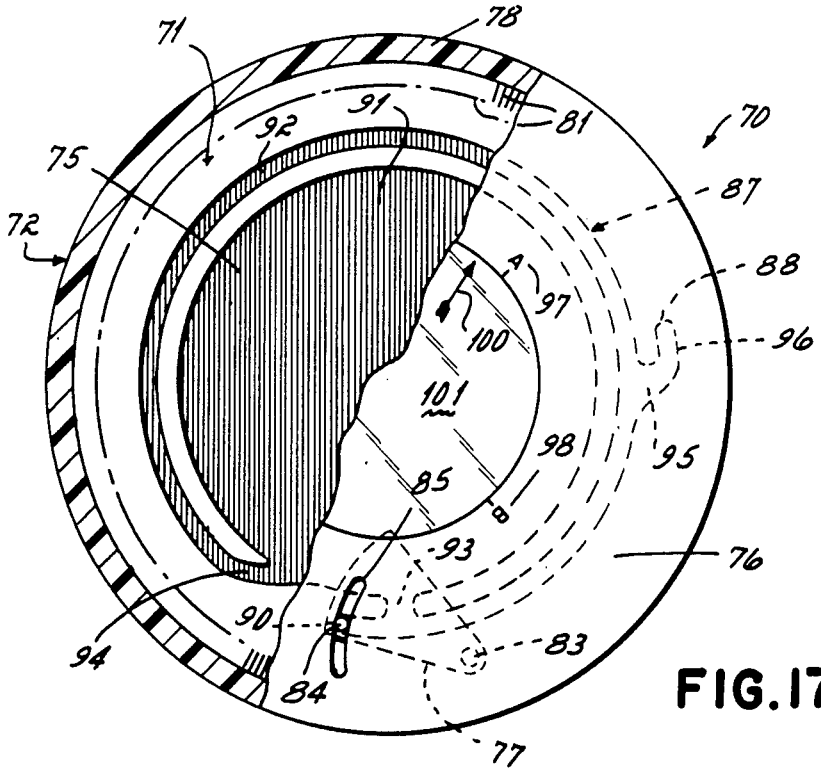
FIG. 17 is a view similar to FIG. 14 showing the outer cap in a position for rotating the inner cap to a closed position.

The configuration of groove 18 is best shown in FIG. 14. As there shown, the groove comprises an inner circular section 91 and an outer arcuate section 92 disposed intermediate the inner circular section and the periphery of the top cap. Inner section 91 is joined to outer section 92 by means of a first radial section 93 and a return section 94. As in the preferred embodiment, it is to be understood that radial section 93 does not necessarily lie on a true radius. However, it does lead outwardly from the intersection outwardly toward the outer section 92. Outer section 92 terminates in a closed end or abutment 90 disposed on the side of section 93 remote from return section 94. Between radial section 93 and return section 94 another radial groove section 95 is connected to groove section 92. As shown in FIG. 14, groove section 95 extends outwardly and includes an arcuate section 96 which terminates in abutment with closed end 88.

In order to assist in manipulating the closure, three indicia are provided. As illustrated in FIG. 14, two indicia, e.g. the letters "A" and "B" indicated by numerals 97 and 98, are placed on the outer cap and a third indicia such as arrow 100 is placed on the top wall of the inner cap. Arrow 100 is rendered visible through a window 101 formed of transparent material.

The modified cap 70 is assembled in the same manner as preferred form of cap 11. Its operation is best understood from FIGS. 14–17. Assuming that the inner cap is threaded over the mouth of a container 10 and that the driving lug 86 is disposed in inner circular slot section 91, as shown in FIG. 14, the outer cap is freely rotatable around the inner cap. To open the closure the outer cap is rotated until the first indicia "A" is brought into registry with arrow 100. This indicates that driving lug 86 is aligned with radial section 93. The precise registry of lug 86 and section 93 is journaled by the engagement of connecting serrations 81 and 82. In the next step, operating lug 84 is shifted outwardly to bring driving lug 86 into arcuate section 92 (see FIG. 15). Thereafter, the outer cap is rotated in a counterclockwise direction until indicia "B" is brought into registry with arrow 100 (see FIG. 16). At this time driving lug 86 is disposed at the juncture of section 92 with groove section 95. Operating pin 84 is then shifted outwardly to bring the driving lug into groove section 96. At that point the outer cap can be rotated counterclockwise to bring driving lug 86 into engagement with abutment 88. This establishes a driving connection between the outer and inner caps so that further counterclockwise rotation of the outer cap causes the inner cap to be unthreaded from the container. In order to replace the closure the inner cap is threaded over the mouth of the container and the outer cap is rotated in a clockwise direction. This causes driving lug 86 to be cammed into groove section 92 and to move along that section into contact with closed end or abutment 90. Further clockwise rotation at the outer cap establishes a driving connection wit the inner cap. The closure is returned to a "safety" position by rotating the outer cap in a counterclockwise direction which causes driving lug 86 to travel along section 92 and to enter return section 94 through which it passes into inner circular slot section 91. Once the driving lug has entered that section, the outer cap may be rotated freely about the inner cap.

Figure 18:
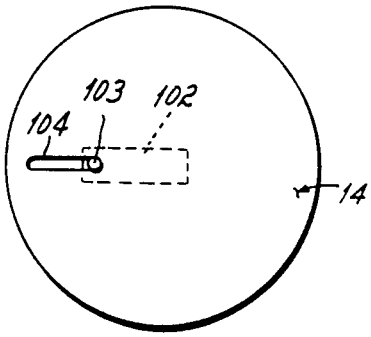
FIG. 18 is a plan view of a modified outer cap showing a modified operating and driving lug mounting.

It is contemplated that additional modifications or additions may be made to either closure 11 or closure 70. One such modification is illustrated in FIG. 18. As there shown, the operating lug and driving lug are not mounted on a pivot member such as member 27, but rather are respectively mounted above and below a reciprocating member 102 which reciprocates in and out in a radial direction within a suitable track formed on the top cap. In this embodiment operating lug 103 moves in a straight line so that the top wall of the outer cap is provided with a linear slot 104 as opposed to an arcuate slot described above.

Figure 19:
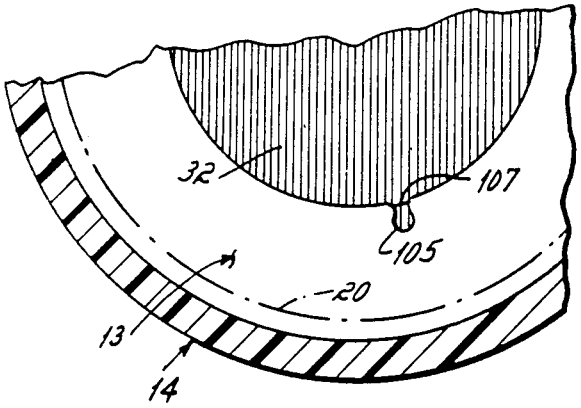
FIG. 19 is a partial plan view of a modified closure with a locking recess.

A further modification means are provided for selectively disabling the "safety" feature of the cap in the event that there is no danger that the container will fall into the hands of children. One preferred form of such means is illustrated in FIG. 19. As there shown, a locking recess 105 is formed in the peripheral wall of a circular section 32. A resistance gate 107 is disposed at the entrance of this locking slot. It is to be understood that this resistance gate is dimensioned to require substantially more effort to pass the driving lug through it than is the case with resistance gates **42*a* and 42*b***.

When it is desired to eliminate the "safety" feature of the closure so that the closure may be opened and closed simply by rotating the outer cap, the outer cap is rotated to bring the driving lug into registry with gate 107. The operating lug is then shifted outwardly to shift the driving lug into locking recess 105. It is held in that position by resistance gate 107. So long as driving lug 26 is disposed in the locking recess, the outer and inner caps are locked together and rotate as a unit. As an alternative, it is contemplated that the inner and outer caps can also be selectively locked by means of a pin or other member which is pressed into aligned openings in the inner and outer caps.

In a still further modification of the present invention, it is contemplated that means can be provided for enabling the operation of the cap by feel. Thus, for example, bumps may be provided on the walls of the grooves so that they are engaged by lug 26 when the lug is positioned to enter gates 42*a* and 42*b*. Alternatively, means can be provided to produce an audible signal when the lug reaches these positions.

From the foregoing description of the general principles of the present invention, and the above description of the preferred embodiments, those skilled in the art will readily comprehend further modifications to which the present invention is susceptible.

Accordingly, I desire to be limited only by the scope of the following claims, I claim:

1. A safety closure for a threaded container adapted to store a potentially harmful substance, said closure comprising an inner cap having internal threads for engagement with the threads of said container, an outer cap substantially enclosing said inner cap and being rotatably supported thereby, a driving lug, means carried by said outer cap for supporting said driving lug for radial movement relative to said outer cap, groove means on said inner cap receiving said driving lug said groove means comprising an inner circular section, a first radial section, an intermediate arcuate section, said first radial section extending between said inner circular section and said intermediate arcuate section, a second radial section, an outer arcuate section having first and second abutments, said second radial section extending between said intermediate section and said outer arcuate section, said outer cap being effective to rotate said inner cap in one direction when said drive lug engages said first abutment and in the opposite direction when the drive lug engages the second abutment.

2. The safety closure of claim 1 further comprising a return section interconnecting said outer most arcuate section and said intermediate arcuate section.

3. The safety closure of claim 2 further comprising a third radial slot section interconnecting said intermediate section and said inner circular section.

4. The safety closure of claim 1 further comprising a third radial slot section interconnecting said intermediate section and said inner circular section.

5. The safety closure of claim 1 in which said means for supporting said driving lug comprises a pivot member and means pivotally connecting said pivot member to said outer cap.

6. The safety closure of claim 5 further comprising an outwardly extending operating lug carried by said pivot member and a slot in said outer cap receiving said driving lug.

7. The safety cap of claim 5 further comprising a transparent window in said outer cap, a first indicia on said inner cap, said first indicia being in registry with said window when said driving lug is disposed at the juncture of said inner circular section and said first radial section, a second indicia on said pivot member, said second indicia being in registry with said window when said driving lug has moved along said first radial section and is positioned to enter said intermediate arcuate section and a third indicia on said inner cap said third indicia being in registry with said window when said driving lug is disposed at the juncture of said second radial section and said intermediate arcuate section and a fourth indicia on pivot member said fourth indicia being in registry with said window when said driving lug is disposed at the juncture of said second radial slot and said outer arcuate slot.

8. The safety cap of claim 7 further comprising an outwardly extending operating lug carried by said pivot member and a slot in said outer cap receiving said operating lug, fifth indicia and sixth indicia on said outer cap adjacent said guide slot in respective alignment with the positions of said operating lug when said driving lug is in registry with said intermediate arcuate section and said outer arcuate section respectively.

9. The safety closure of claim 1 further comprising a plurality of first serrations extending around the periphery of said inner cap and cooperating serrations on said outer cap disposed in engagement with said first serrations.

10. The safety cap of claim 1 further comprising first resistant gate means disposed at the juncture of said inner circular section and said first radial section and second resistant gate means at the juncture of said intermediate arcuate section and said second radial section, first one-way gate means disposed at the juncture of said outer arcuate section and said second radial section and second one-way gate means disposed at the juncture of said return section and said intermediate arcuate section and third one-way gate means at the juncture of said third radial section and said inner circular section.

11. A safety closure for a threaded container adapted to store a potentially harmful substance, said closure comprising an inner cap having internal threads for engagement with the threads of said container, an outer cap substantially enclosing said inner cap and being rotatably supported thereby, a driving lug, means carried by said outer cap for supporting said driving lug for movement toward and away from the circumference of said outer cap, groove means on said inner cap receiving and driving lug said groove means comprising an inner circular section, a first arcuate section disposed radially outwardly of said inner circular section, a radial section interconnecting said inner circular section and said arcuate section, an outer section disposed outwardly of said first arcuate section and interconnected thereto, said outer section having a first abutment, said outer cap being effective to rotate said inner cap to open said inner cap when said driving lug is in engagement with said first abutment, a second abutment in a section communicating with said first arcuate section and circumferentially spaced from said first abutment, said outer cap being effective to drive said inner cap to tighten said inner cap when said driving lug is in engagement with said second abutment.

12. The cap of claim 11 in which said second abstract is formed at one end of said first arcuate section.

13. The cap of claim 12 further comprising a return section interconnecting said first arcuate section and said inner circular section.

14. The cap of claim 13 in which said return section is connected to the first arcuate section at the opposite end thereof from said second abutment.

15. The cap of claim 11 further comprising a pivot member carrying said driving lug, and means pivotally supporting said pivot member on said outer cap.

16. The cap of claim 15 further comprising an outwardly extending lug carried by said pivot member and arcuate slot in said outer cap for receiving said outwardly extending lug.

17. The cap of claim 11 further comprising cooperating indicia on said inner cap and said outer cap for indicating when said drive lug is disposed at the juncture of said inner circular section and said radial section and when said drive pin is disposed at the juncture of said first arcuate section and the interconnection with said outer section.

* * * * *

UNITED STATES PATENT AND TRADEMARK OFFICE

CERTIFICATE OF CORRECTION

PATENT NO. : 4,690,292

DATED : September 1, 1987

INVENTOR(S) : John C. Henning

It is certified that error appears in the above-identified patent and that said Letters Patent is hereby corrected as shown below:

Column 8, line 24 "wit" should be

-- with --

Column 10, line 34 "and" should be

-- said --

Column 10, line 49 "abstract" should be

-- abutment --

Signed and Sealed this

Second Day of February, 1988

*Attest:*

DONALD J. QUIGG

*Attesting Officer*

*Commissioner of Patents and Trademarks*